US006308360B1

(12) United States Patent
Stein

(10) Patent No.: US 6,308,360 B1
(45) Date of Patent: Oct. 30, 2001

(54) ROTATING DISC-TYPE FLOOR POLISHING MACHINE

(75) Inventor: Thomas Stein, Velbert (DE)

(73) Assignee: Stein & Co., GmbH, Velbert (DE)

( * ) Notice: Subject to any disclaimer, the term of this patent is extended or adjusted under 35 U.S.C. 154(b) by 0 days.

(21) Appl. No.: 09/459,508

(22) Filed: Dec. 13, 1999

(30) Foreign Application Priority Data

Dec. 14, 1998 (DE) ..... 198 57 628

(51) Int. Cl.[7] ..... A47L 11/162; A47L 11/206
(52) U.S. Cl. ..... 15/98; 15/49.1
(58) Field of Search ..... 15/49.1, 50.1, 15/98, 385

(56) References Cited

U.S. PATENT DOCUMENTS 4,122,576 * 10/1978 Bevington et al. ..... 15/98
4,731,895 * 3/1988 Zack et al. ..... 15/98
4,742,652 * 5/1988 Cannan et al. ..... 15/98
5,127,124 * 7/1992 Palmer et al. ..... 15/98
5,615,437 * 4/1997 Takahashi et al. ..... 15/98

* cited by examiner

*Primary Examiner*—Terrence R. Till
(74) *Attorney, Agent, or Firm*—Nils H. Ljungman & Associates

(57) ABSTRACT

A floor care machine realized in the form of a floor polishing machine contains a driven pad, the height of which pad can be adjusted automatically to adjust the application pressure to take the characteristics of the floor into consideration. For this purpose, between the driving element and the driven element, there is a transmission element which forms a torque regulator. For this purpose, the driven element can be rotated with respect to the driving element opposite to the working direction of rotation and can also be displaced axially, whereby the transmission element with a clamping element automatically regulates the displacement and rotation, thereby acting as a torque regulator to regulate the height of the pad with respect to the floor as a function of the torque.

14 Claims, 12 Drawing Sheets

1
2
3
4
5
6
7
8
9
10
11
12
13
14
15
16
17
20
21

21
15
19
18
14
11
8
12
17

ROTATING DISC-TYPE FLOOR POLISHING MACHINE

BACKGROUND OF THE INVENTION

1. Field of the Invention

The present invention relates to a floor care machine, such as a floor polisher, with at least one floor care disc that can be driven in rotation and acts as a polisher disc. The machine can be designed in particular in the form of what is designated in the trade as a high-speed machine, whereby a frame supports a drive unit with the polishing disc, and the frame is movably supported on the floor by means of guide elements, and the height of the polishing disc with respect to the floor can be adjusted to set the application pressure, taking the characteristics of the floor into consideration.

2. Background Information

Floor care machines of this type are described in some publications for industrial and professional applications. One problem with these high-speed machines, so called because the polishing disc, which is also designated a "pad", rotates at high speed, is that depending on the characteristics of the floor, the application pressure of the pad against the floor must be adjusted manually. This adjustment is necessary to avoid causing any damage to the floor surface, to achieve a continuous result and to ensure that the drive mechanism will not be overloaded. Therefore the application pressure on the floor can only be adjusted by trained or qualified operators, which limits the use of the machine to applications in the industrial and professional sector.

OBJECT OF THE INVENTION

An object of the present invention is to improve a system of the type described above to make it possible to substantially adjust the machine to the current floor conditions, to automatically adjust the height of the pad and to achieve a substantially continuous result. In other words, an object of the present invention can be to make a floor care machine that automatically responds to various conditions of the floor to adjust the height of the pad relative to the floor and therefore obtain a substantially even finish over all areas of the floor.

SUMMARY OF THE INVENTION

The invention teaches that the drive system is connected with a driving element that is mounted so that it rotates in the axis of rotation of the pad, which driving element is connected via a transmission element with a coaxial driven element as the drive shaft for the pad. The driven element is installed so that it can rotate and move axially with respect to the driving element and can be displaced axially, whereby the transmission element with a clamping element automatically regulates the displacement and rotation, thereby acting as a torque regulator to regulate the height of the pad with respect to the floor as a function of the torque.

In other words, the present invention teaches that the drive system can be connected with a driving element mounted so that it rotates in the axis of rotation of the pad. This driving element can be connected via a transmission element with a coaxial driven element to form the drive shaft for the pad. Additionally, the drive element can be installed so that it can rotate around the driving element so that the transmission element, which has a torsion spring or a clamping, gripping, or chucking element, may automatically regulate the torque of the pad and thereby regulate the height of the pad relative to the floor as a function of the torque.

One advantage of the invention is that there is a substantially precise regulation of the power of the drive unit, whereby the torque that occurs and thus the output are used as a controlled variable and the height of the pad above the floor is used as the manipulated variable. The height adjustment is made when the machine is turned on and off, and is substantially achieved by the rotational inertia of mass into the upper or lower limit position, unless the drive system is provided with a process that increases and decreases the speed gradually when the machine is turned on or off.

In one advantageous embodiment of the invention, the drive system can substantially increase the speed of rotation of the pad gradually when the floor machine is turned on and can substantially decrease the speed of rotation of the pad gradually when the floor machine is turned off.

In one advantageous embodiment of the invention, the pad may be set at an angle to the floor in the range of up to about 3 degrees.

In other words, in one possible embodiment of the invention, the back of the pad may be set at an angle to the floor in the range of up to approximately 3 degrees—that is, the back of the pad may be higher than the front of the pad.

In another possible embodiment of the invention, the front of the pad may be set at an angle to the floor in the range of up to approximately 3 degrees—that is, the front of the pad may be higher than the back of the pad.

In another possible embodiment of the invention, the front of the pad may be set at an angle to the floor, which angle may be approximately 0.5 degrees, 1.0 degrees, 1.5 degrees, 2.0 degrees, or 2.5 degrees—that is, the front of the pad may be higher than the back of the pad.

In yet another possible embodiment of the invention, the back of the pad may be set at an angle to the floor, which angle may be approximately 0.5 degrees, 1.0 degrees, 1.5 degrees, 2.0 degrees, or 2.5 degrees—that is, the back of the pad may be higher than the front of the pad.

In a further possible embodiment of the invention, the front of the pad may be set at an angle to the floor, which angle may be approximately 3.5 degrees, 4.0 degrees, or 4.5 degrees—that is, the front of the pad may be higher than the back of the pad.

In yet a further possible embodiment of the invention, the back of the pad may be set at an angle to the floor, which angle may be approximately 3.5 degrees, 4.0 degrees, or 4.5 degrees—that is, the back of the pad may be higher than the front of the pad.

In an additional advantageous embodiment, there is a guide element in the form of a roller to support the frame in the axis of rotation of the pad.

In another possible embodiment of the invention, the drive element may rotate in either a clockwise or counterclockwise direction.

To create substantially favorable conditions for operation, the invention teaches that the torque regulator formed from the transmission element and the clamping element between the input element and the driven element, has a $PT_2$ control response.

In other words, to create substantially favorable conditions for operation, the invention teaches that the torque regulator formed from the transmission element and the torsion spring between the driving element and the driven element, has a $PT_2$ or second-order time delay control response. This time delay control response may provide for a delay in the height of the pad, the driving element, and the driven element to prevent flailing or uncontrolled fluctuation, oscillation, or chattering of the pad, the driving element, and the driven element, which flailing or uncontrolled fluctuation, oscillation, or chattering may damage the floor or parts of the floor care machine. In other words, the $PT_2$ or second-order time delay control response may regulate the height and speed of the pad such that the pad may move upward or downward substantially slowly when it encounters a substantially small bump in the floor and may move substantially quickly when it encounters a substantially large bump in the floor.

In one embodiment of the invention, the factors involved in determining the $PT_2$ or second-order time delay control response may include the number of turns on the helical or spiral guides, the number of turns on the torsion spring or clamping element, the weight of the pad or disc, and the angle of the parallel helical guides on the driving element and the corresponding guides on the driven element, the height of the pad or disc, the position of the guide rods, and the position of the coupling rods.

To realize an additional advantageous arrangement, the invention teaches that the driving element is substantially realized in the form of a ring-shaped sleeve, and is rotationally mounted by means of a stationary shaft of the frame, whereby the driving element coaxially holds a sleeve as the driven element along with the transmission element and the clamping element.

In other words, to realize an additional advantageous arrangement, the invention teaches that the driving element can be substantially realized in the form of a ring-shaped sleeve, which may be mounted by means of a ball bearing system to a stationary shaft of the frame, which mounting arrangement may allow such driving element to rotate. Additionally, such driving element may coaxially hold a driven element, which driven element may be in the form of a sleeve, as well as a transmission element and a torsion spring, which torsion spring may be in the form of a clamping element.

In one embodiment of the invention, the transmission elements are located by means of helical guides on the sleeve-shaped driving element, and corresponding guides on the coaxially oriented driven element for rotation with axial displacement, whereby the clamping element is formed by a torsion spring which pushes the driven element in the direction of the application pressure of the pad against the floor.

In other words, in one embodiment of the invention, the transmission elements may be located by means of helical or spiral guides on the sleeve-shaped driving element, and may also be located by means of corresponding helical or spiral guides on the coaxially oriented driven element, so that the driven element may rotate. Additionally, in this embodiment of the invention, a torsion spring in the form of a clamping, gripping, or chucking element may push the driven element in the direction of the application pressure of the pad against the floor.

For this purpose, additional advantageous embodiments are substantially realized in which the sleeve-shaped driving element has a plurality of parallel helical guides distributed over the periphery and corresponding guides on the driven element. Substantially favorable conditions are also achieved in that balls are located between the corresponding guides on the driving element and on the driven element.

In other words, additional advantageous embodiments are substantially realized in which the sleeve-shaped driving element may have a plurality of helical or spiral guides, which guides may be parallel to one another, distributed over the surface of such sleeve-shaped driving element, and in which the driven element may have a plurality of corresponding helical or spiral guides, which guides may be parallel to one another, distributed over the surface of such driven element. Substantially favorable conditions may also be achieved in that balls may be located between the helical or spiral guides on the surface of the driving element and the corresponding helical or spiral guides on the surface of the driven element.

For the direct coupling of the driving element and the driven element, the invention alternatively teaches that the transmission elements between the sleeve-shaped driving element and the coaxially oriented driven element are formed by guide rods, which are coupled between the driving element and the driven element, and which, when the elements are rotated or displaced axially, change their position by swinging.

In other words, the invention alternatively teaches that the transmission elements between the sleeve-shaped driving element and the coaxially oriented driven element can be formed by guide rods, which guide rods, when the driving element and the coaxially oriented driven element are rotated or displaced axially, may change their position by swinging, oscillating, vibrating, or swaying.

In an additional alternative configuration, the transmission elements between the sleeve-shaped driving element and the coaxially oriented driven element are formed by cable elements that are coupled between the driving element and the driven element, and which change their positions in the event of the rotation and axial displacement of the elements.

In other words, in an additional alternative configuration, the transmission elements between the sleeve-shaped driving element and the coaxially oriented driven element can be formed by cable elements that are coupled between the driving element and the driven element, which cable elements change their positions when the driving element and the driven element are rotated.

In one advantageous embodiment, the coupling points for the guide rods or cable elements are formed by bolts that are formed as stops by or through associated notches in the terminal positions of the driving element and the adjusted driven element.

In other words, in one possible embodiment, the coupling points for the guide rods or cable elements may be formed by bolts by or through associated notches in the terminal or limit positions of the driving element and the axially displaced driven element.

In other words, in one possible embodiment, the transmission element may have, as the connection between the driving element and the driven element, three parallel guide rods coupled on both ends by means of bolts, whereby there may also be a torsion spring in the form of a clamping element. In this embodiment, such a configuration may also form a torque converter, whereby, by means of the swinging, swaying, oscillation, or vibration of the guide rods between the driving element and the driven element, the driving element and the driven element may rotate.

In another advantageous embodiment, the driving element and the driven element may rotate in either a clockwise or a counterclockwise direction.

The above discussed embodiments of the present invention will be described further hereinbelow with reference to the accompanying figures. When the word "invention" is used in this specification, the word "invention" includes "inventions", that is, the plural of "invention". By stating "invention", the Applicants do not in any way admit that the present application does not include more than one patentably and non-obviously distinct invention, and maintains that this application may include more than one patentably and non-obviously distinct invention. The Applicants hereby assert that the disclosure of this application may include more than one invention, and, in the event that there is more than one invention, that these inventions may be patentable and non-obvious one with respect to the other.

BRIEF DESCRIPTION OF THE DRAWINGS

Exemplary embodiments of the invention are illustrated schematically in the accompanying drawings, in which.

DESCRIPTION OF THE PREFERRED EMBODIMENT

Figure 1:
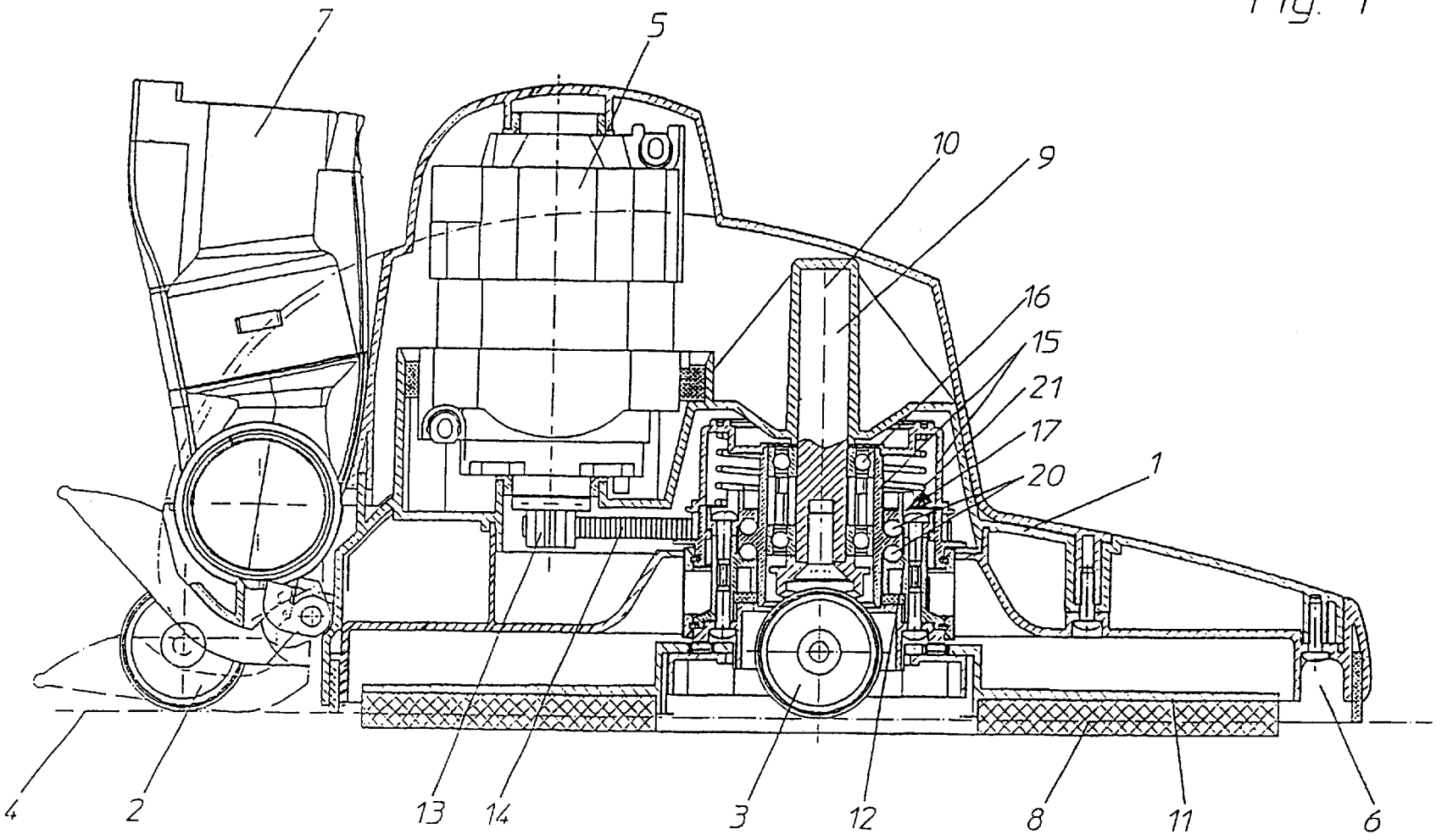
FIG. 1 is a section through a floor polishing machine and a torque regulator for a pad, the height of which can be adjusted by means of helical guides.
Figure 2:
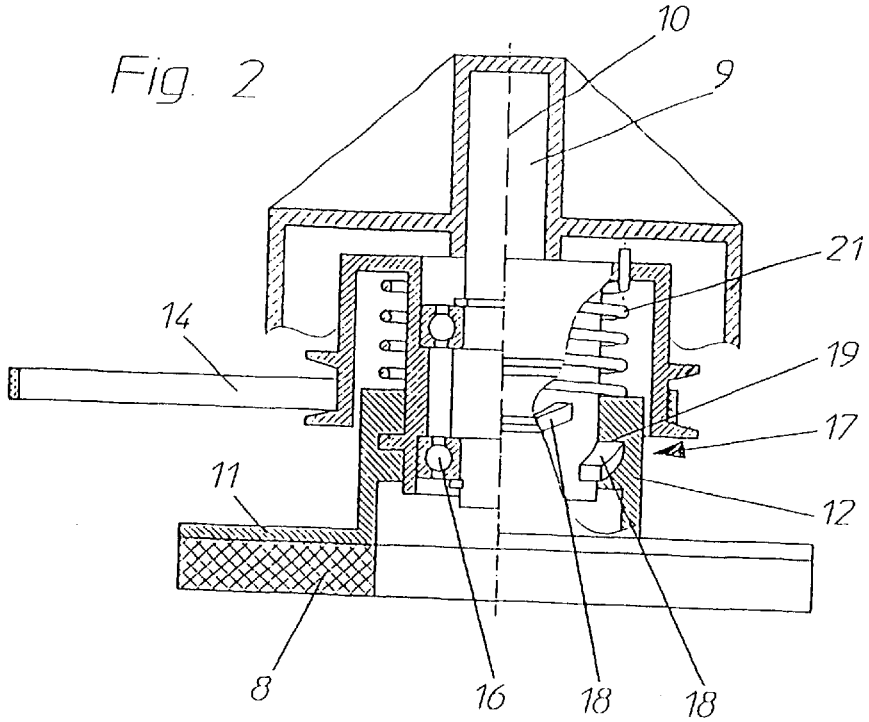
FIG. 2 shows a torque regulator as illustrated in FIG. 1 in cross section along Line III—III in FIG. 3, in the extended position of the pad.
Figure 3:
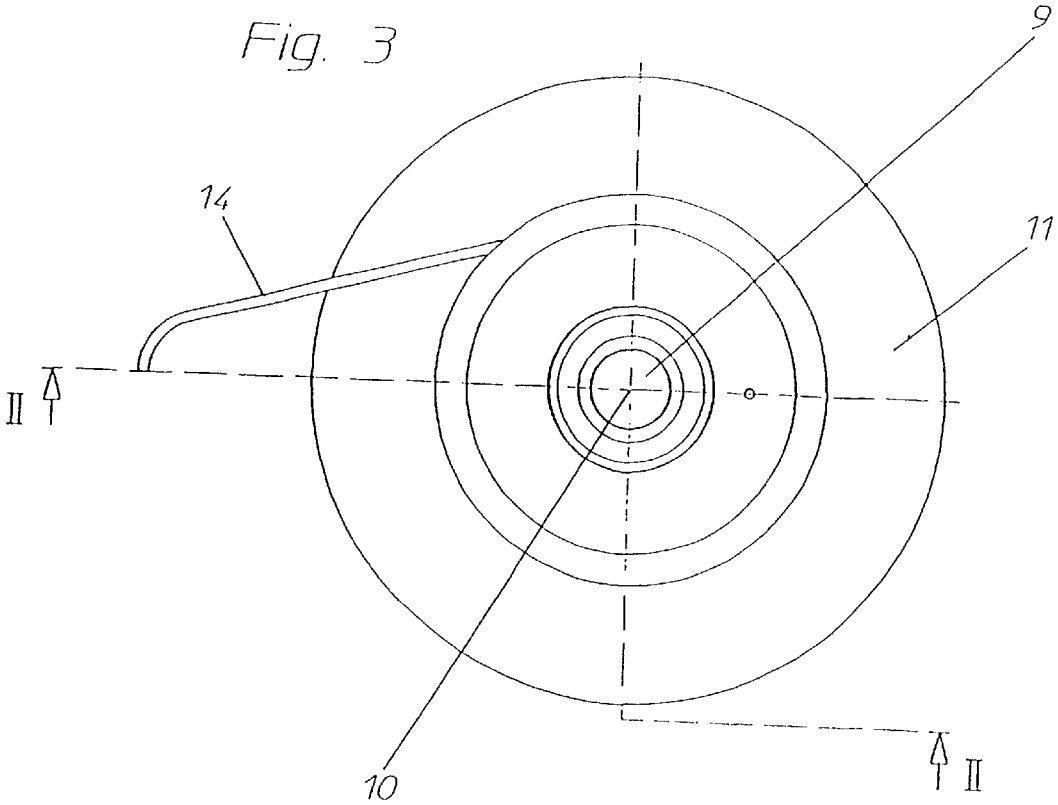
FIG. 3 is a plan view of the device illustrated in FIG. 2.
Figure 4:
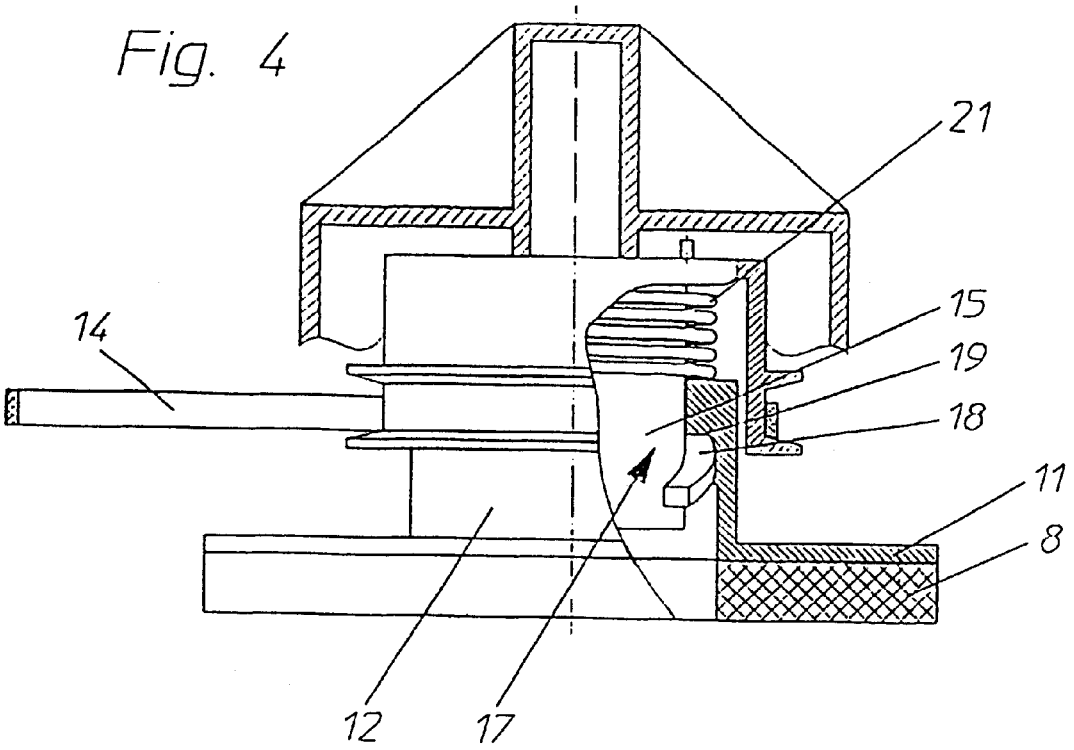
FIG. 4 shows a torque regulator as illustrated in FIG. 2 in the retracted position of the pad.
Figure 5:
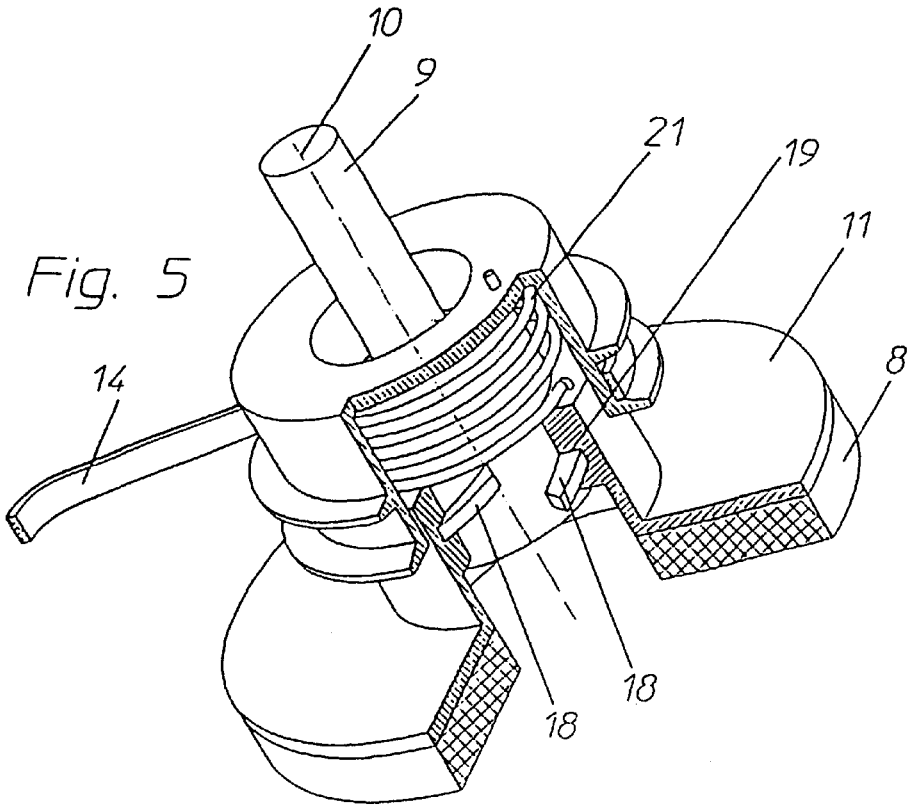
FIG. 5 and FIG. 6 are views in perspective of the torque regulator illustrated in FIG. 1 in the extended and retracted positions of the pad.
Figure 6:
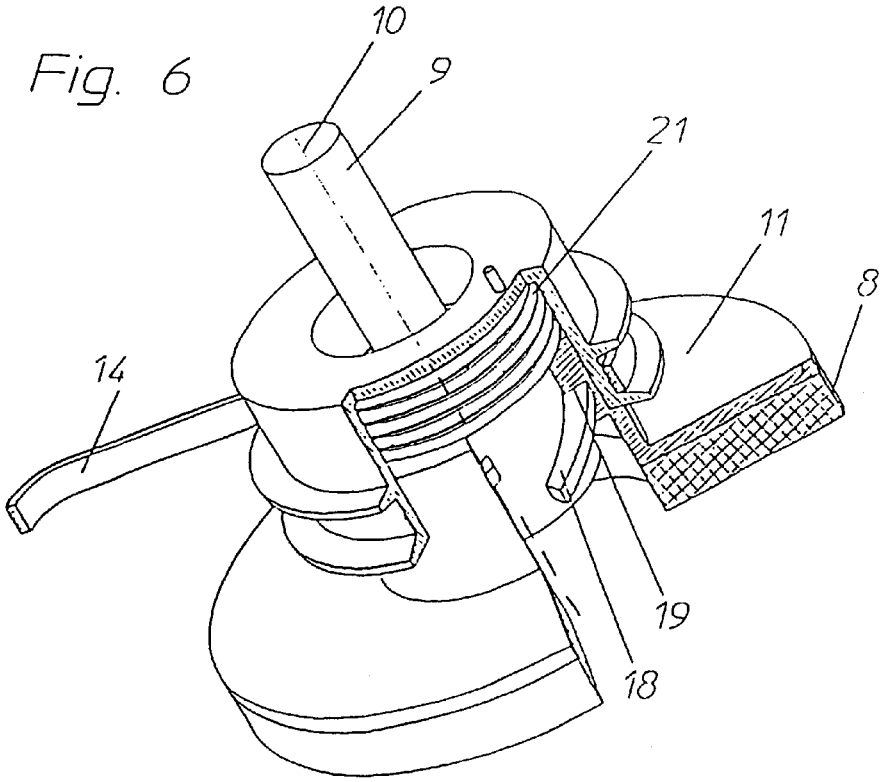
Figure 7:
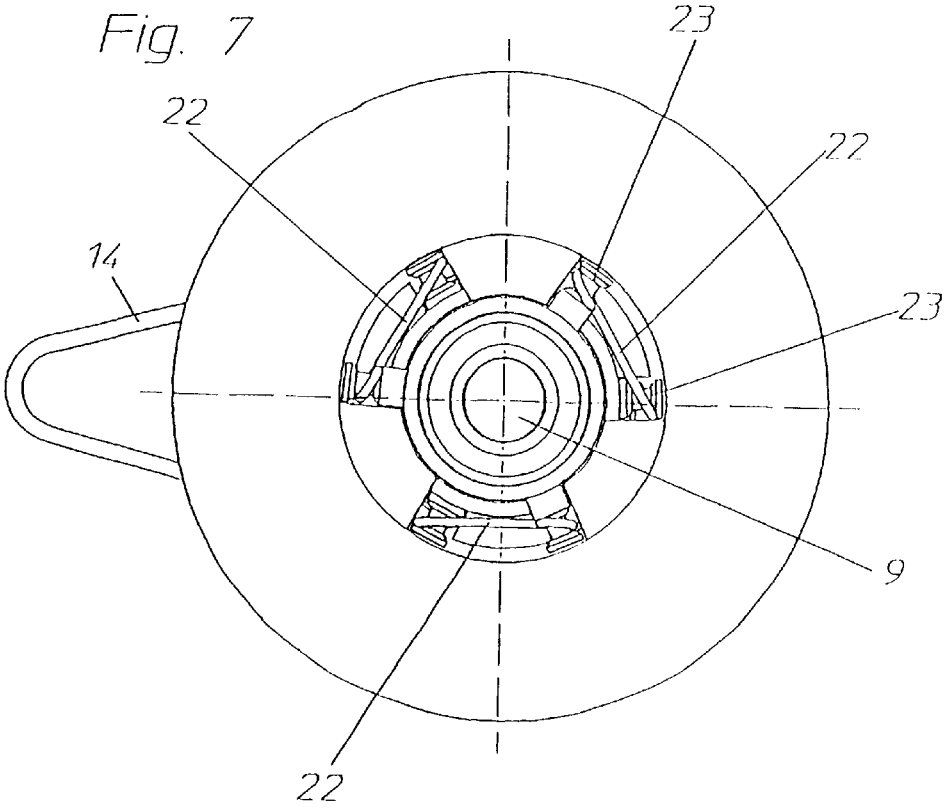
FIG. 7 and FIG. 8 show a second exemplary embodiment of a torque regulator with guide rods in the retracted position of the pad, in a plan view and in a side view.
Figure 8:
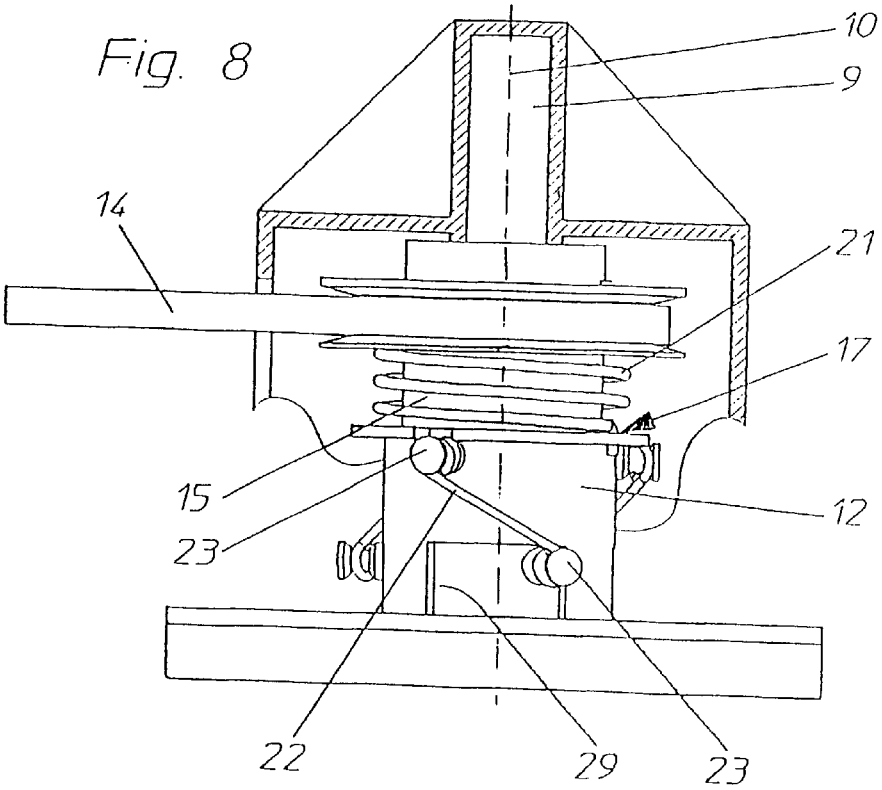
Figure 9:
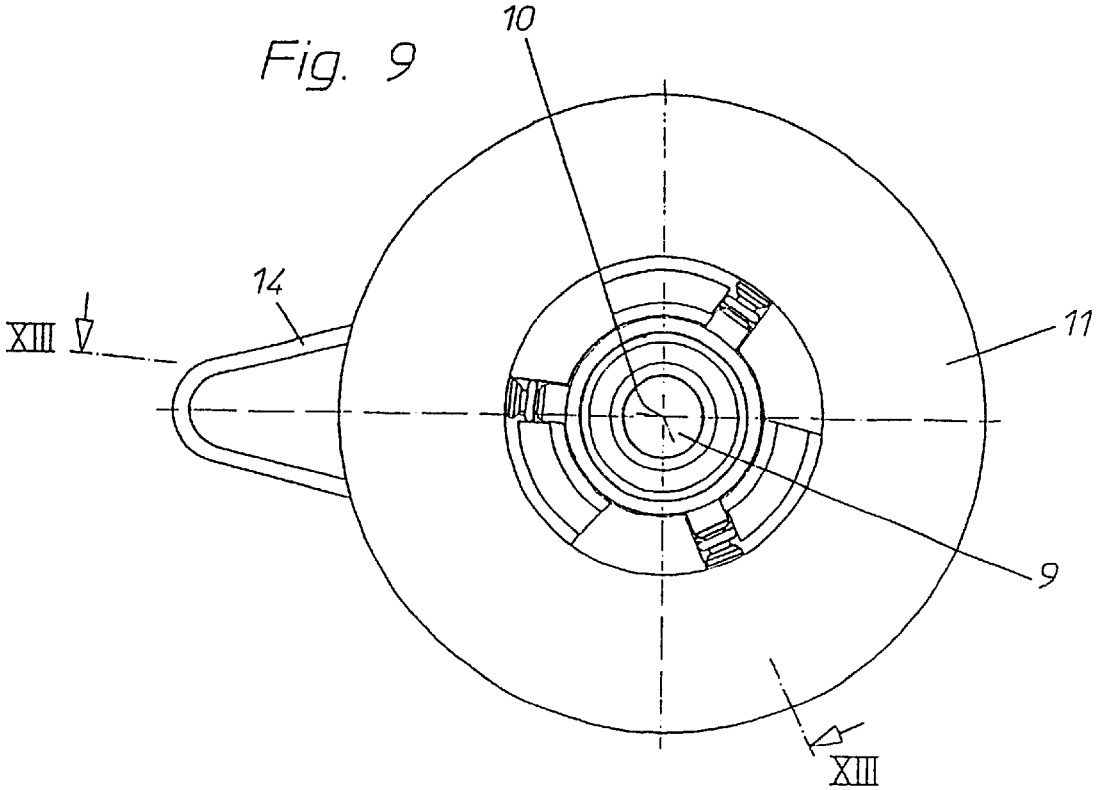
FIG. 9 and FIG. 10 are illustrations of the device illustrated in FIGS. 7 and 8 in the extended position of the pad.
Figure 10:
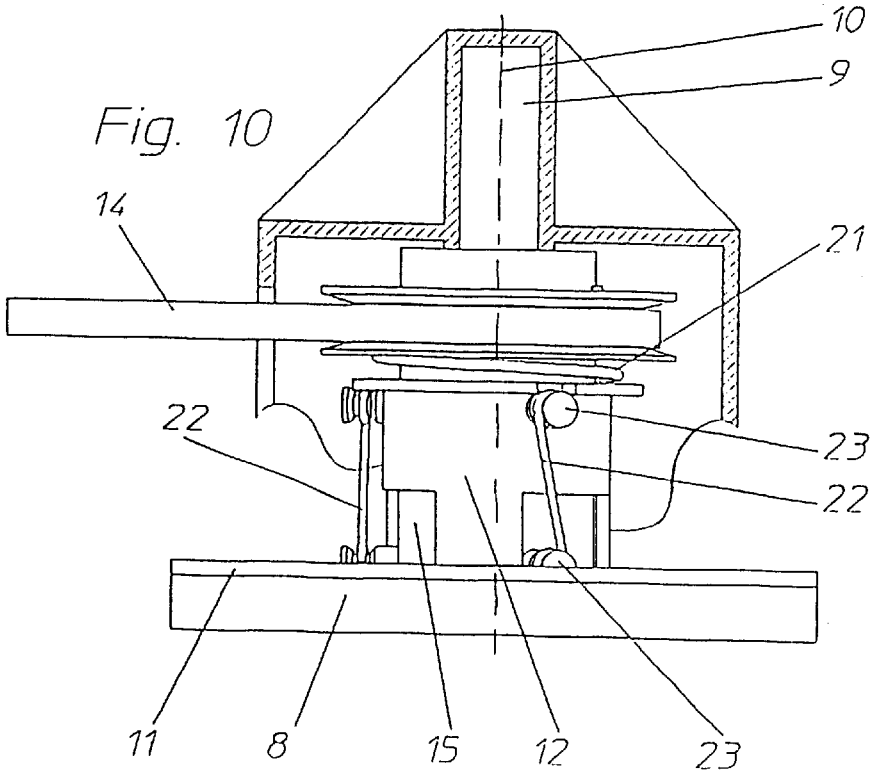
Figure 11:
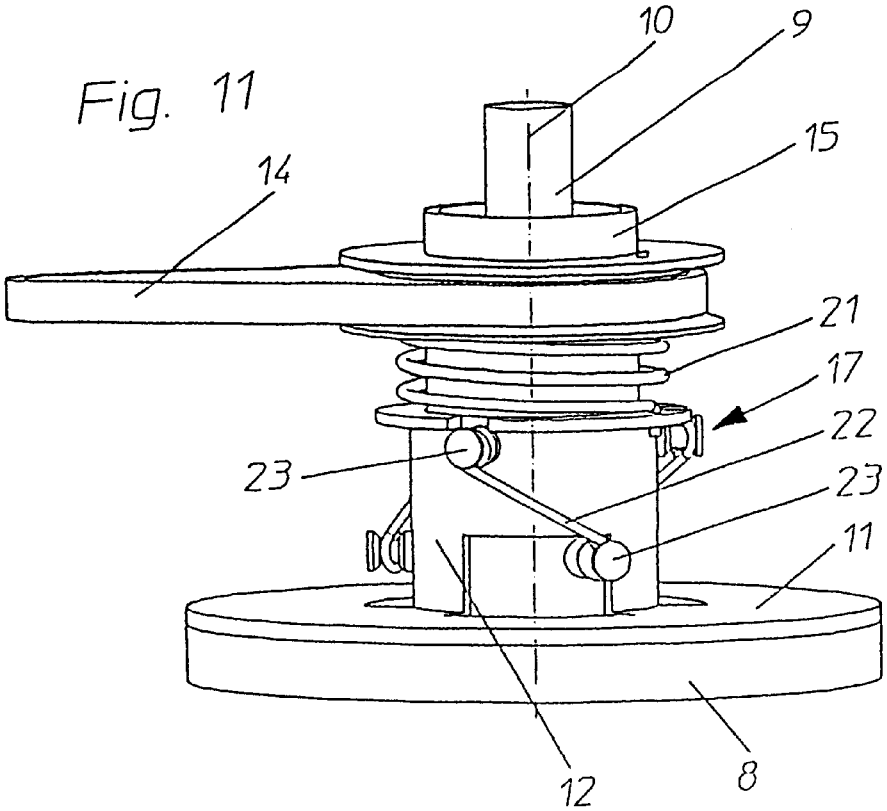
FIG. 11 and FIG. 12 are views in perspective of the device illustrated in FIGS. 7 and 9 in the retracted and extended positions of the pad.
Figure 12:
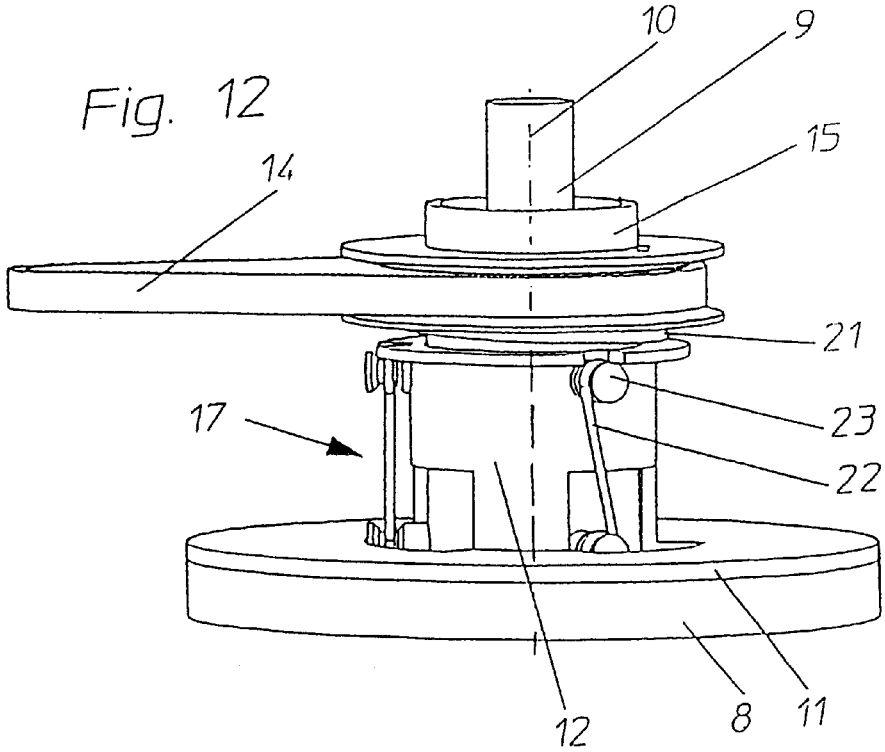
Figure 13:
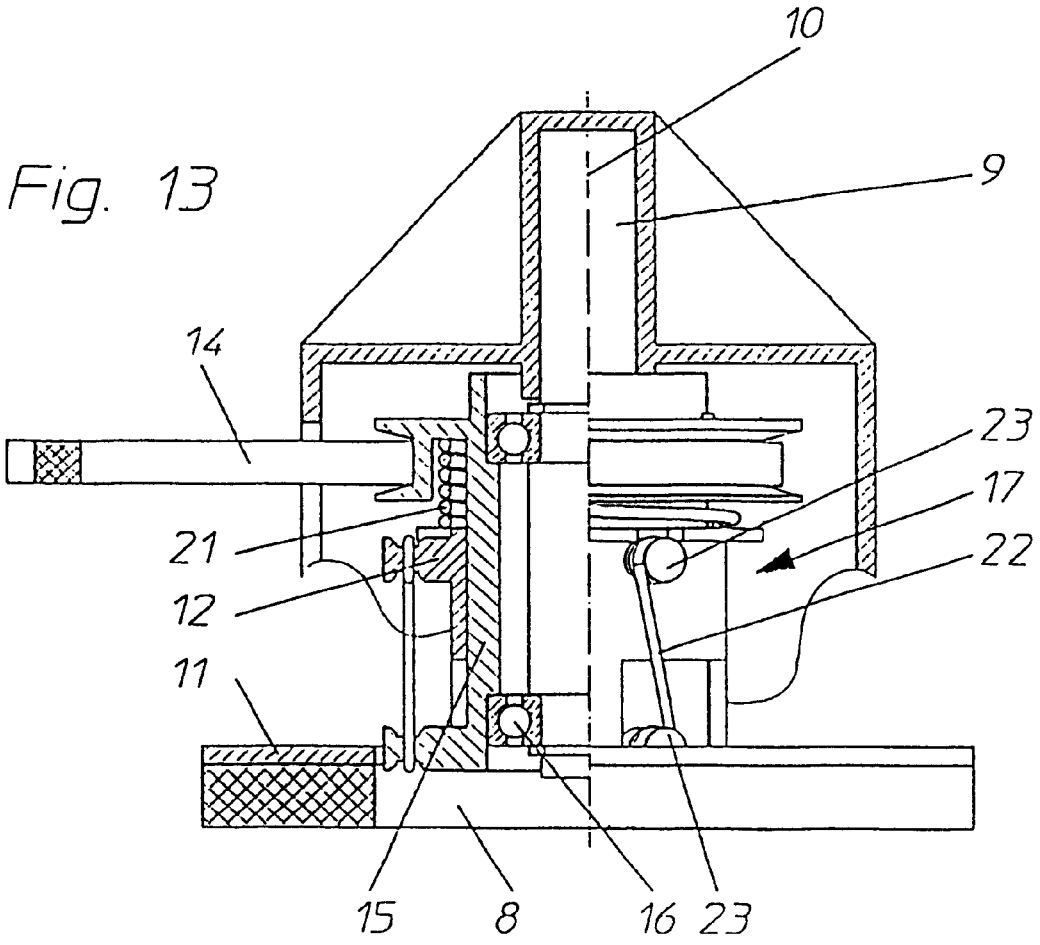
FIG. 13 is a sectional view along Line XIII—XIII in FIG. 9.
Figure 14:
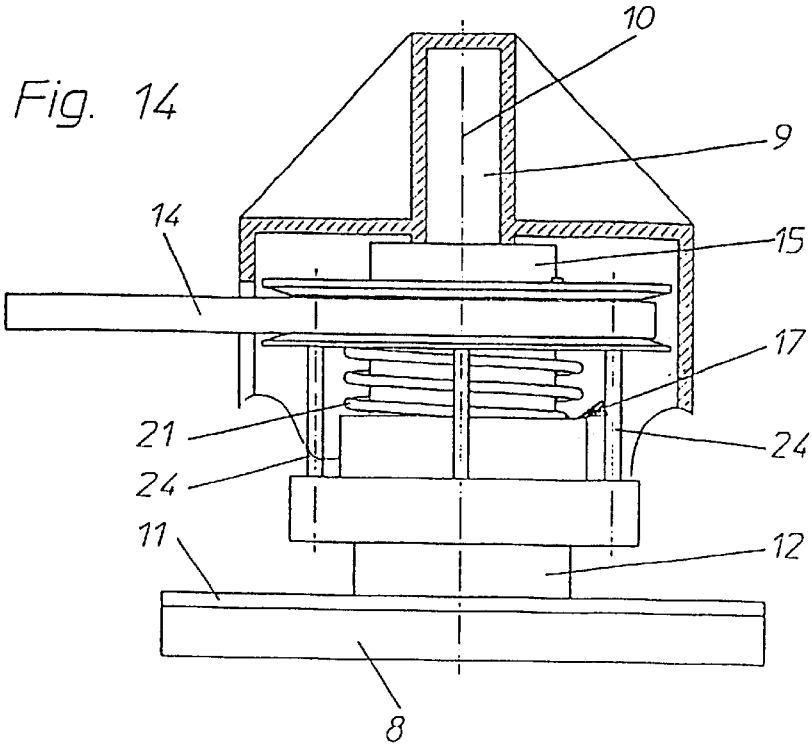
FIG. 14 and FIG. 15 show a third exemplary embodiment of a torque regulator with cable elements in the extended position of the pad, in a side view and in a plan view.
Figure 15:
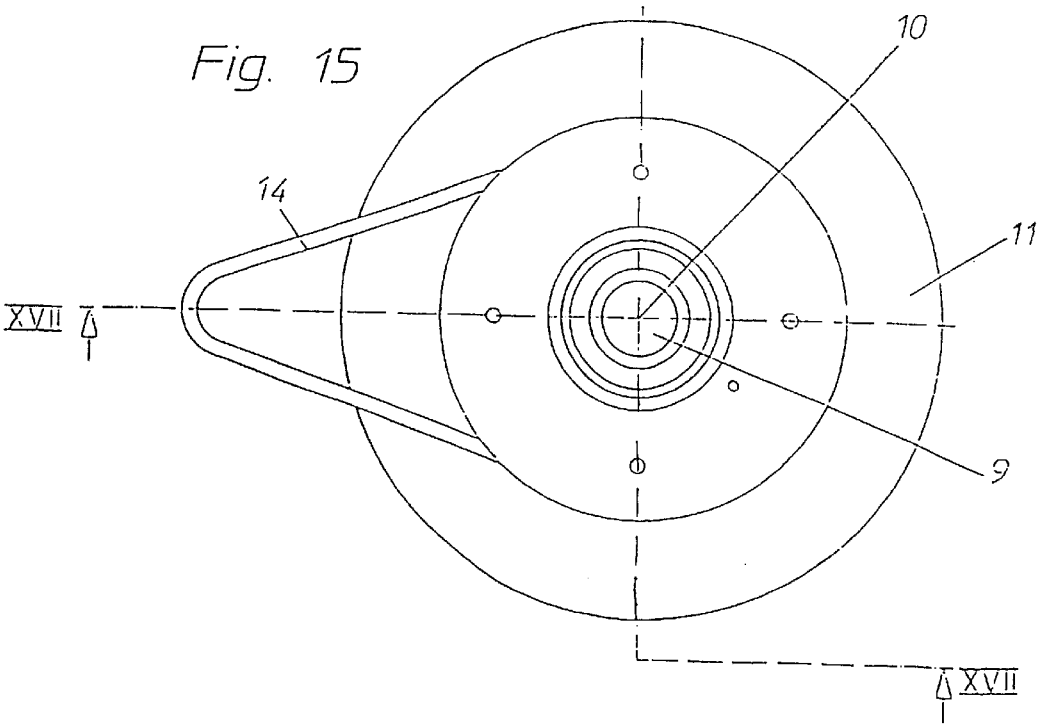
Figure 16:
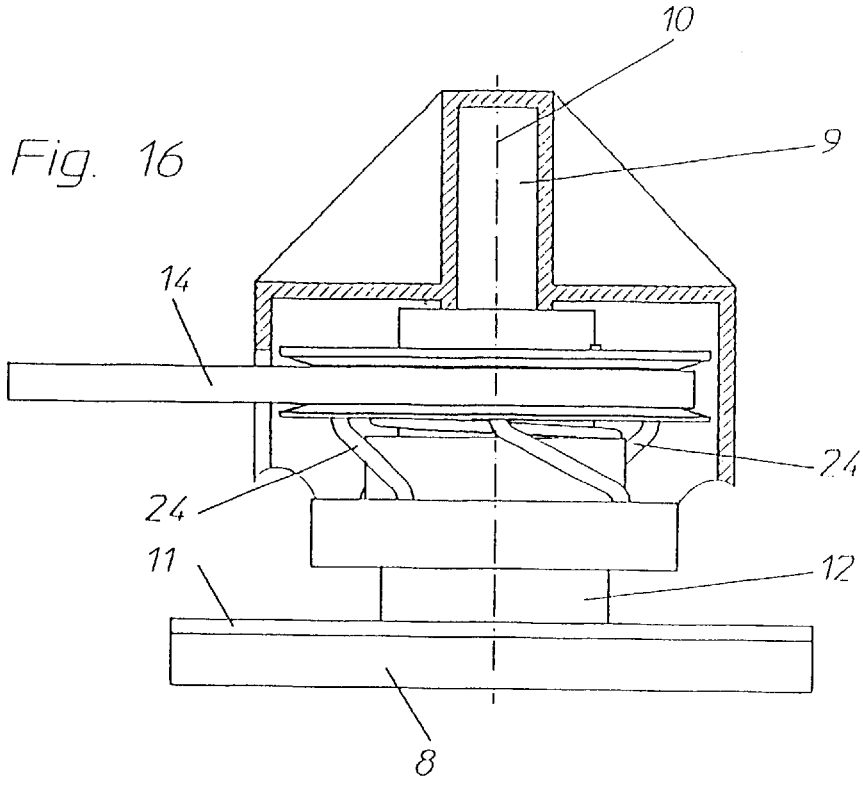
FIG. 16 is a side view of the device illustrated in FIG. 14, in the retracted position of the pad.
Figure 17:
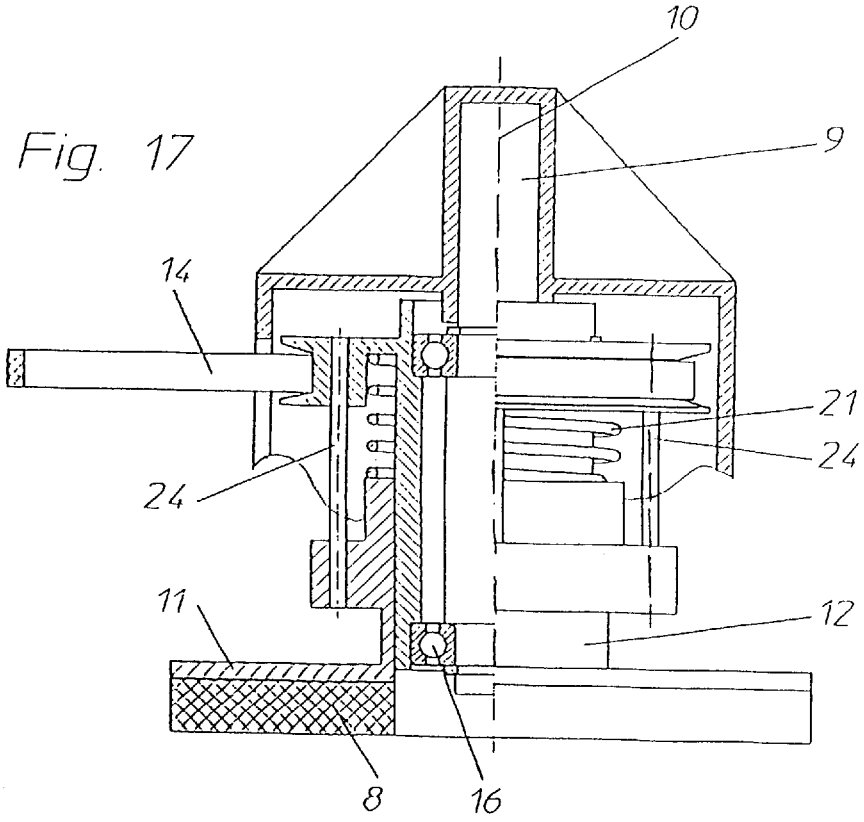
FIG. 17 is a sectional view along line XVII—XVII in FIG. 15.
Figure 18:
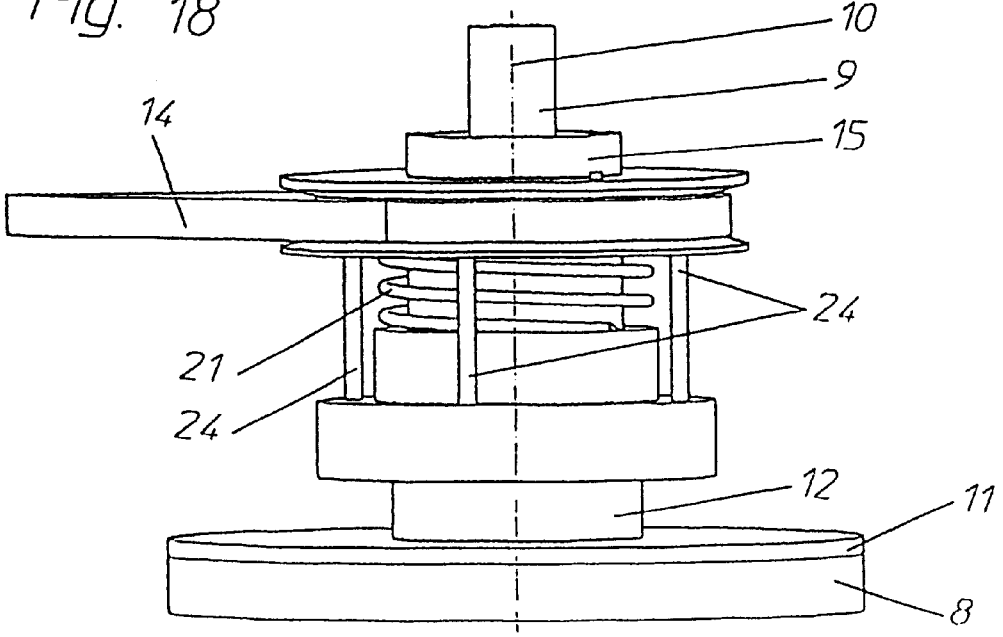
FIG. 18 and FIG. 19 are views in perspective of the device illustrated in FIGS. 14 and 16 in the extended and retracted position of the pad.
Figure 19:
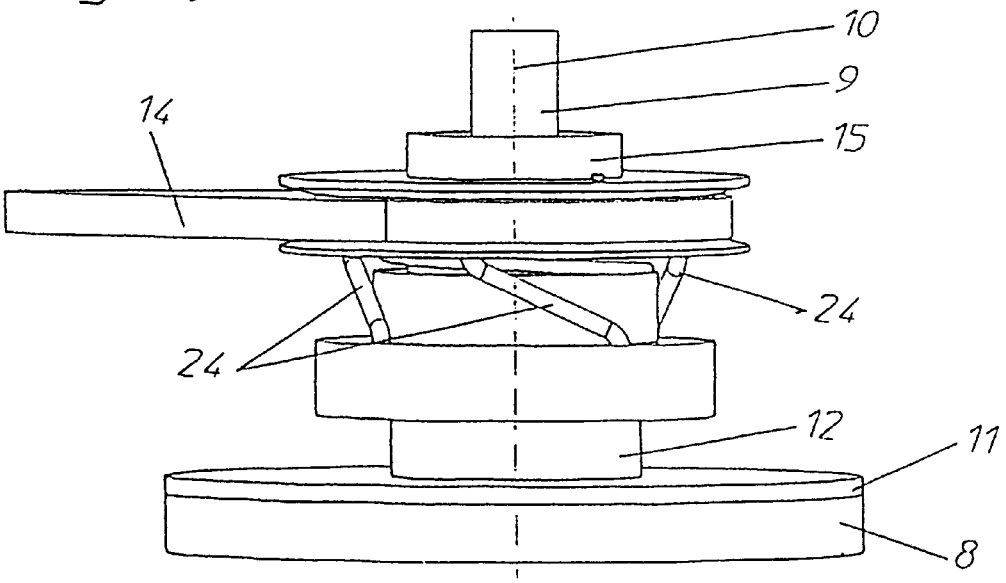

On the illustrated floor care machine, there is a frame 1 which is supported on a floor surface 4 by means of rollers 2 and 3. In this case, two rollers 2 are oriented parallel to each other in the rear area of the frame. The frame 1 also contains a drive motor 5. In this case, the frame 1 also has a suction duct 6 which is connected with a suction device 7.

There is also a polishing disc 8—also designated a "pad"—that can be driven in rotation. This polishing disc 8 is inclined forward with respect to the floor 4 and is at an angle of up to approximately 3 degrees. In this case, there is a stationary shaft 9 in the frame 1 which forms an axis of rotation 10 for the pad 8. For this purpose, the pad 8 is connected with a receptacle 11, which is in turn provided with a sleeve-shaped driven element 12 and is concentric to the shaft 9.

In other words, in one possible embodiment of the invention, the pad bottom 30 at the back of the pad 8 may be set at an angle A to the floor 4 in the range of up to approximately 3 degrees—that is, the back of the pad 8 may be higher than the front of the pad 8.

In another possible embodiment of the invention, the pad bottom 30 at the front of the pad 8 may be set at an angle A to the floor 4 in the range of up to approximately 3 degrees—that is, the front of the pad 8 may be higher than the back of the pad 8.

In another possible embodiment of the invention, the pad bottom 30 at the front of the the pad 8 may be set at an angle A to the floor 4, which angle A may be approximately 0.5 degrees, 1.0 degrees, 1.5 degrees, 2.0 degrees, or 2.5 degrees—that is, the front of the pad 8 may be higher than the back of the pad 8.

In yet another possible embodiment of the invention, the pad bottom 30 at the back of the pad 8 may be set at an angle A to to the floor 4, which angle A may be approximately 0.5 degrees, 1.0 degrees, 1.5 degrees, 2.0 degrees, or 2.5 degrees—that is, the back of the pad 8 may be higher than the front of the pad 8.

In a further possible embodiment of the invention, the pad bottom 30 at the front of the pad 8 may be set at an angle A to the floor 4, which angle A may be approximately 3.5 degrees, 4.0 degrees, or 4.5 degrees—that is, the front of the pad 8 may be higher than the back of the pad 8.

In yet a further possible embodiment of the invention, the pad bottom 30 at the back of the pad 8 may be set at an angle A to the floor 4, which angle A may be approximately 3.5 degrees, 4.0 degrees, or 4.5 degrees—that is, the back of the pad 8 may be higher than the front of the pad 8.

In this case, there is a stationary shaft 9 in the frame 1 which forms an axis of rotation 10 for the pad 8. For this purpose, the pad 8 is connected with a receptacle 11, which is in turn provided with a sleeve-shaped driven element 12 and is concentric to the shaft 9.

To drive the pad 8, the drive motor 5 is connected by means of a pinion 13 and a toothed belt 14 with a sleeve-shaped driving element 15. In this case, the driving element 15 is realized in the manner of a double sleeve that forms an annular space. The driving element 15 in the form of a double sleeve is rotationally mounted on the stationary shaft 9 in the frame 1 by means of a ball bearing system 16, and is driven by means of the toothed belt 14.

The driving element 15 in the form of a double sleeve contains, in its annular space, the driven element 12, which is connected by means of a transmission element 17 as the torque regulator with the driving element 15.

The transmission element 17, as illustrated in FIG. 1 to FIG. 6, is in the form of a corkscrew formed by three guides 18 that run in a spiral fashion and are distributed parallel over the periphery of the driving element 15, associated with which guides there are corresponding guides 19 on the driven element 12 that is coaxial to the driving element 15, whereby in this case there are balls 20 between them. Between the driving element 15 and the driven element 12, there is also a torsion spring 21 in the form of a clamping element, which pushes the driven element 12 in the direction of the application pressure of the pad 8 against the floor 4.

The torque converter formed by the transmission element 17 from the guides 18 and 19, ball bearing 20 and torsion spring 21 makes it possible, depending on the sizing, to rotate the driven element 12 with respect to the driving element 15 relative to one another opposite to the working rotation direction of the pad 8 and to displace the driven element 12 axially, and thus to automatically regulate the height of the pad above the floor 4 as a function of the torque. It is thereby possible to automatically adapt the height of the pad to the current conditions.

In the additional embodiment illustrated in FIGS. 7 to 13, the transmission element 17 has, as the connection between the driving element 15 and the driven element 12, three parallel guide rods 22 which are coupled on both ends by means of bolts 23, whereby there is also a torsion spring 21 in the form of a clamping element. This configuration also forms a torque converter, whereby, by means of the guide rods 22 there is a rotation of the driven element 12 and the driving element 15 opposite to the working direction of rotation, to one another and an axial displacement. In this case, the bolts 23 are simultaneously used as stops for the terminal positions in corresponding notches 29 in the driven element 12.

FIGS. 14 to 18 show an additional exemplary embodiment, whereby the transmission element 17 has, as the connection between the driving element 15 and the driven element 12, three parallel cable elements 24, which are coupled on both ends, with a torsion spring 21 as the corresponding clamping element. This arrangement, as in the other embodiments, forms a torque converter, so that there is a rotation of the elements 15 and 12 relative to one another, opposite to the working direction of rotation, and an axial displacement.

Figure 20:
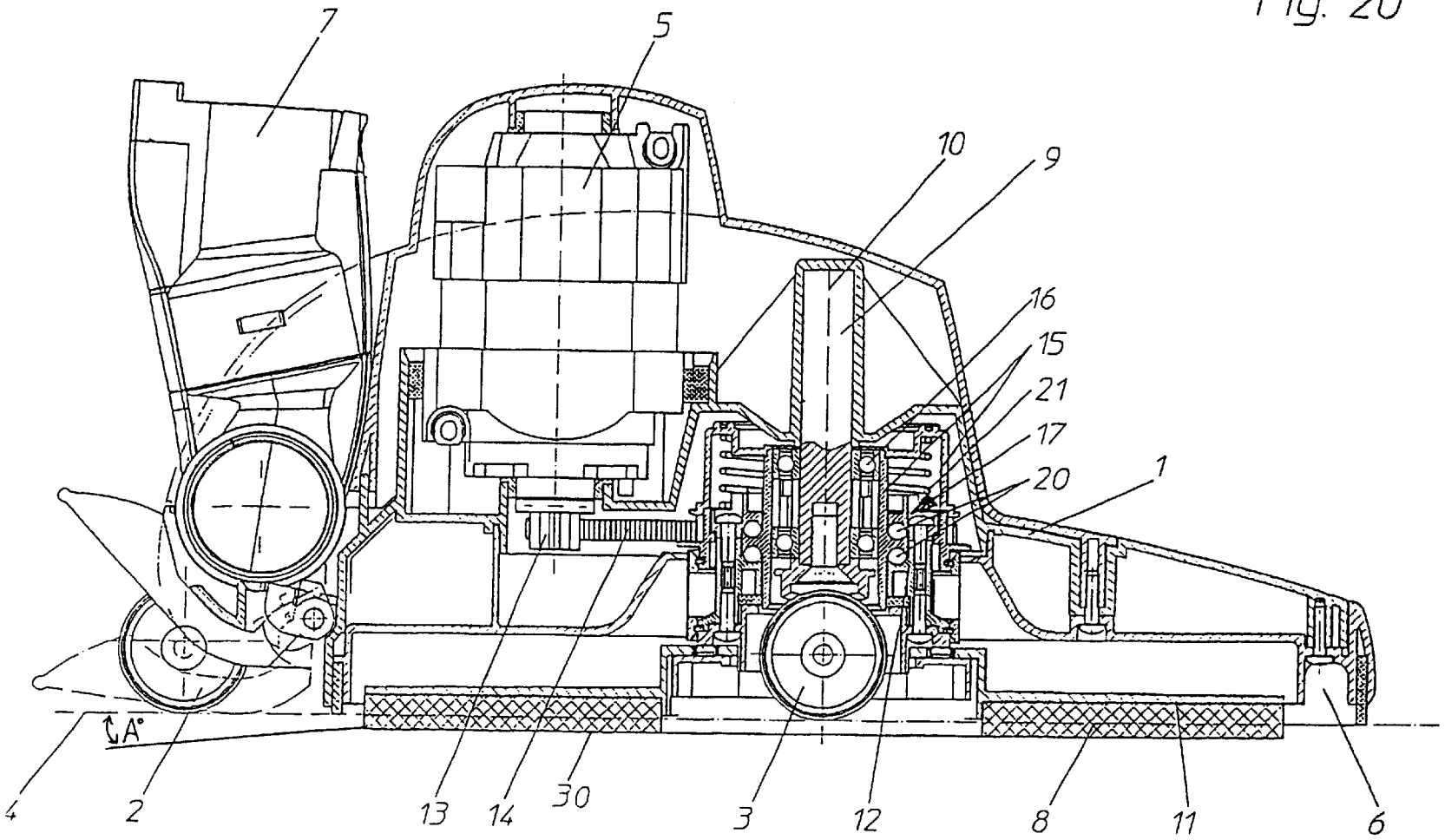
FIG. 20 is a section through a floor polishing machine and a torque regulator for a pad, the height of which can be adjusted by means of helical guides, showing the approximate angle A at which the back or front of the pad may be set in relation to the floor.

In the additional embodiment shown in FIG. 20, the pad bottom 30 is at an angle A with respect to the floor 4 in the range of up to approximately 3 degrees.

In other words, in one possible embodiment of the invention, the pad bottom 30 at the back of the pad 8 may be set at an angle A to the floor 4 in the range of up to approximately 3 degrees—that is, the back of the pad 8 may be higher than the front of the pad 8.

In another possible embodiment of the invention, the pad bottom 30 at the front of the pad 8 may be set at an angle A to the floor 4 in the range of up to approximately 3 degrees—that is, the front of the pad 8 may be higher than the back of the pad 8.

In another possible embodiment of the invention, the pad bottom 30 at the front of the the pad 8 may be set at an angle A to the floor 4, which angle A may be approximately 0.5 degrees, 1.0 degrees, 1.5 degrees, 2.0 degrees, or 2.5 degrees—that is, the front of the pad 8 may be higher than the back of the pad 8.

In yet another possible embodiment of the invention, the pad bottom 30 at the back of the pad 8 may be set at an angle A to the floor 4, which angle A may be approximately 0.5 degrees, 1.0 degrees, 1.5 degrees, 2.0 degrees, or 2.5 degrees that is, the back of the pad 8 may be higher than the front of the pad 8.

In a further possible embodiment of the invention, the pad bottom 30 at the front of the pad 8 may be set at an angle A to the floor 4, which angle A may be approximately 3.5 degrees, 4.0 degrees, or 4.5 degrees—that is, the front of the pad 8 may be higher than the back of the pad 8.

In yet a further possible embodiment of the invention, the pad bottom 30 at the back of the pad 8 may be set at an angle A to the floor 4, which angle A may be approximately 3.5 degrees, 4.0 degrees, or 4.5 degrees—that is, the back of the pad 8 may be higher than the front of the pad 8.

One feature of the invention resides broadly in the floor care machine, such as a floor polishing machine, with at least one floor care disc in the form of a pad that can be driven in rotation, which is designed in particular in the form of a high-speed machine, whereby a frame supports a drive with the pad, and is supported by means of guide elements so that it can be moved over the floor, and the height of the pad can be adjusted with respect to the floor to set the application pressure, taking the characteristics of the floor surface into consideration, characterized by the fact that the drive system 5, 14 is connected with a driving element 15 that is rotationally mounted in the axis of rotation 10 of the pad 8, which driving element 15 is connected by means of a transmission element 17 with a coaxial driven element 12 as the drive Shaft for the pad 8, and that the driven element 12 is mounted so that it can rotate with respect to the driving element 15 and can be displaced axially, whereby the transmission element 17 with a clamping element 21 automatically regulates the displacement and rotation, thereby acting as a torque regulator to regulate the height of the pad 8 with respect to the floor 4 as a function of the torque.

Another feature of the invention resides broadly in the floor care machine characterized by the fact that the pad 8 is at an angle with respect to the floor 4 in the range of up to approximately 3 degrees.

Yet another feature of the invention resides broadly in the floor care machine characterized by the fact that there is a guide element in the form of a roller 3 to support the frame 1 in the axis of rotation 10 of the pad 8.

Still another feature of the invention resides broadly in the floor care machine characterized by the fact that the torque regulator formed from the transmission element 17 and the clamping element 21 between the driving element 15 and the driven element 12 has a $PT_2$ control response.

In other words, still another feature of the invention resides broadly in the floor care machine wherein the torque regulator formed from the transmission element and the torsion spring in the form of a clamping element, which transmission element and torsion spring in the form of a clamping element are between the driving element and the driven element, may have a $PT_2$ or second-order time delay control response.

A further feature of the invention resides broadly in a floor care machine as claimed in one of the claims 1 to 4, characterized by the fact that the driving element 15 is realized in the shape of a sleeve and is rotationally mounted by means of a stationary shaft 9 of the frame 1, whereby the driving element 15 coaxially holds a sleeve as the driven element 12 with the transmission element 17 and the clamping element 21.

Another feature of the invention resides broadly in the floor care machine characterized by the fact that the transmission elements 17 are formed by helical guides 18 on the sleeve-shaped driving element 15 and corresponding guides 19 on the coaxial driven element 12 for rotation with axial displacement, whereby the clamping element 21 is formed by a torsion spring that presses the driven element 12 in the direction of the application pressure of the pad 8 against the floor 4.

Yet another feature of the invention resides broadly in the floor care machine characterized by the fact that the sleeve-shaped driving element 15 has a plurality of parallel helical guides 18 distributed over the periphery, and there are corresponding guides 19 on the driven element 12.

Still another feature of the invention resides broadly in the floor care machine characterized by the fact that balls 20 are located between the corresponding guides 18, 19 on the driving element 15 and on the driving element 12.

A further feature of the invention resides broadly in the floor care machine characterized by the fact that the transmission elements 17 are formed between the sleeve-shaped driving element 15 and the coaxial driven element 12 by guide rods 22 that are coupled between the driving element 15 and the driven element 12, and which, when the elements 12 and 15 are rotated or displaced axially, change their position by swinging, swaying, oscillating, or vibrating.

Another feature of the invention resides broadly in the floor care machine characterized by the fact that the transmission elements 17 between the sleeve-shaped driving element 15 and the coaxial driven element 12 are formed by cable elements 24 which are coupled between the driving element 15 and the driven element 12, and change their position when the elements 12 and 15 are rotated and displaced axially.

Yet another feature of the invention resides broadly in the floor care machine characterized by the fact that the coupling points for the guide rods 22 or cable elements 24 are formed by bolts which are formed as stops in the limit positions of the driving element 15 and the adjusted driven element 12 by or through associated notches 29.

Some examples of coupling and damping coupling systems that may possibly be used in conjunction with the present invention are described in U.S. Pat. No. 5,741,187, entitled "Flexible Shaft-Coupling", having the inventors Wolf et al., issued Apr. 21, 1998; U.S. Pat. No. 5,050,446, entitled "Vibration and Torsional Damping Coupling for a Power Transmission", having the inventors Takashima et al., issued Sep. 24, 1991; U.S. Pat. No. 4,240,763, entitled "Resilient Couplings", having the inventor Moore, issued Dec. 23, 1980; and U.S. Pat. No. 4,012,923, entitled "Vibration Damping Coupling", having the inventor Lundgren, issued Mar. 22, 1977.

Some examples of cleaning machines that may possibly be used in conjunction with the present invention are described in U.S. Pat. No. 5,056,175, entitled "A Floor Cleaning Machine", issued Oct. 15, 1991; U.S. Pat. No. 5,819,370, entitled "Floorcare Machines Such as Vacuum Cleaners", issued Oct. 13, 1998; U.S. Pat. No. 5,815,883, entitled "Vacuum Cleaner and a Handle for Suction Lines Thereof", issued Oct. 6, 1998; U.S. Pat. No. 5,255,410, entitled "Vacuum Cleaner", issued Oct. 26, 1993; U.S. Pat. No. 5,028,245, entitled "A Vacuum Cleaner Including Filter Bag Mounting Apparatus", issued Jul. 2, 1991; U.S. Pat. No. 5,228,169, entitled "Brush Type Vacuum Cleaner", issued Jul. 20, 1993; and U.S. Pat. No. 4,955,106, entitled "Upright Vacuum Cleaner", issued Sep. 11, 1990.

The components disclosed in the various publications, disclosed or incorporated by reference herein, may be used in the embodiments of the present invention, as well as, equivalents thereof.

The appended drawings in their entirety, including all dimensions, proportions and/or shapes in at least one embodiment of the invention, are accurate and to scale and are hereby included by reference into this specification.

All, or substantially all, of the components and methods of the various embodiments may be used with at least one embodiment or all of the embodiments, if more than one embodiment is described herein.

All of the patents, patent applications and publications recited herein, and in the Declaration attached hereto, are hereby incorporated by reference as if set forth in their entirety herein.

The corresponding foreign patent publication applications, namely, Federal Republic of Germany Patent Application No. 198 57 628.5, filed on Dec. 14, 1998, having inventor Thomas Stein, and DE-OS 198 57 628.5 and DE-PS 198 57 628.5 as well as their published equivalents, and other equivalents or corresponding applications, if any, in corresponding cases in the Federal Republic of Germany and elsewhere, and the references cited in any of the documents cited herein, are hereby incorporated by reference as if set forth in their entirety herein.

The details in the patents, patent applications and publications may be considered to be incorporable, at applicant's option, into the claims during prosecution as further limitations in the claims to patentably distinguish any amended claims from any applied prior art.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims. In the claims, means-plus-function clause are intended to cover the structures described herein as performing the recited function and not only structural equivalents but also equivalent structures.

It is within the concept of the invention to provide the height adjusting system in any driven pad floor care machine or any other floor care machine which would require change in height in the element which provides care for the floor.

The invention as described hereinabove in the context of the preferred embodiments is not to be taken as limited to all of the provided details thereof, since modifications and variations thereof may be made without departing from the spirit and scope of the invention.

What is claimed is:

1. A rotating disc-type floor polishing machine with at least one floor polishing disc in the form of a pad that can be driven in rotation, which is designed in particular in the form of a high-speed machine, whereby a frame supports a drive with the pad, and is supported by means of guide elements so that it can be moved over the floor, and the height of the pad can be adjusted with respect to the floor to set the application pressure, taking the characteristics of the floor surface into consideration, wherein the drive is connected with a driving element that is rotationally mounted in the axis of rotation of the pad, which driving element is connected by means of transmission elements with a coaxial driven element as the drive shaft for the pad, and that the driven element is mounted so that it can rotate with respect to the driving element and can be displaced axially, whereby the transmission element with a clamping element automatically regulates the displacement and rotation, thereby acting as a torque regulator to regulate the height of the pad with respect to the floor as a function of the torque.

2. The rotating disc-type floor polishing machine according to claim 1, wherein the pad is at an angle with respect to the floor in the range of up to approximately 3 degrees.

3. The rotating disc-type floor polishing machine according to claim 2, wherein there is a guide element in the form of a roller to support the frame in the axis of rotation of the pad.

4. The rotating disc-type floor polishing machine according to claim 3, wherein the torque regulator formed from the transmission element and the clamping element between the driving element and the driven element has a $PT_2$ control response.

5. The rotating disc-type floor polishing machine according to claim 4, wherein the driving element is realized in the shape of a sleeve and is rotationally mounted by means of a stationary shaft of the frames whereby the driving element coaxially holds a sleeve as the driven element with the transmission element and the clamping element.

6. The rotating disc-type floor polishing machine according to claim 5, wherein the transmission elements are formed by helical guides on the sleeve-shaped driving element and corresponding guides on the coaxial driven element for rotation with axial displacement, whereby the clamping element is formed by a torsion spring that presses the driven element in the direction of the application pressure of the pad against the floor.

7. The rotating disc-type floor polishing machine according to claim 6, wherein the sleeve-shaped driving element has a plurality of parallel helical guides distributed over the periphery, and corresponding guides on the driven element.

8. The rotating disc-type floor polishing machine according to claim 7, wherein balls are located between the corresponding guides on the driving element and on the driving element.

9. The rotating disc-type floor polishing machine according to claim 8, wherein the transmission elements are formed between the sleeve-shaped driving element and the coaxial driven element by guide rods that are coupled between the driving element and the driven element, and which, when the elements are rotated or displaced axially, change their position by swinging.

10. The rotating disc-type floor polishing machine according to claim 9, wherein the transmission elements between the sleeve-shaped driving element and the coaxial driven element are formed by cable elements which are coupled between the driving element and the driven element, and change their position when the elements are rotated and displaced axially.

11. The rotating disc-type floor polishing machine according to claim 10, wherein the coupling points for the guide rods or cable elements are formed by bolts which are formed as stops in the limit positions of the driving element and the adjusted driven element by associated notches.

12. The rotating disc-type floor polishing machine according to claim 1, wherein there is a guide element in the form of a roller to support the frame in the axis of rotation of the pad.

13. A floor polishing machine, such as a floor buffing machine, with at least one disc-like floor polishing element like a pad or brush wholly or partially in contact with the floor that can be driven in rotation, whereby a frame supports a drive with the floor polishing element or elements, and is supported by means of guide elements so that it can be moved over the floor, and the height of the floor polishing element or elements can adjust with respect to the floor to set the application pressure, taking the characteristics of the floor surface into consideration, wherein the drive system is connected with a driving element that is rotationally mounted in the axis of rotation of each floor polishing element, which driving element is connected by means of a transmission element with a coaxial driven element as the drive shaft for the floor polishing element, and that the driven element is mounted so that it can rotate with respect to the driving element and can be displaced axially, whereby the transmission element with a clamping element automatically regulates the displacement and rotation of the driven element in respect of the driving element, thereby acting as a torque regulator to regulate the height of the floor polishing element with respect to the floor as a function of the torque.

14. The floor polishing machine according to claim 13, wherein rotation of the floor polishing element is in the way of high speed or ultra high speed floor polishing machines.

* * * * *